US010641137B2

(12) United States Patent
Sittner et al.

(10) Patent No.: US 10,641,137 B2
(45) Date of Patent: May 5, 2020

(54) TWO-PIECE BLOCK FOR VARIABLE VALVE TRAIN SYSTEM

(71) Applicant: Schaeffler Technologies AG & Co. KG, Herzogenaurach (DE)

(72) Inventors: Kevin Sittner, West Bloomfield, MI (US); Donald Dixon, Ortonville, MI (US); Béla Hofer, Troy, MI (US); Todd Simcina, Huntington Woods, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 77 days.

(21) Appl. No.: 15/727,067

(22) Filed: Oct. 6, 2017

(65) Prior Publication Data

US 2019/0107012 A1 Apr. 11, 2019

(51) Int. Cl.

| | |
|---|---|
| ***F01L 1/34*** | (2006.01) |
| ***F01L 1/26*** | (2006.01) |
| ***F01L 1/18*** | (2006.01) |
| ***F01L 9/02*** | (2006.01) |
| ***F01L 1/14*** | (2006.01) |
| ***F01L 13/06*** | (2006.01) |
| *F01L 1/24* | (2006.01) |
| *F01L 1/047* | (2006.01) |

(52) U.S. Cl.

CPC ..... *F01L 1/267* (2013.01); *F01L 1/146* (2013.01); *F01L 1/185* (2013.01); *F01L 9/021* (2013.01); *F01L 13/06* (2013.01); *F01L 1/2422* (2013.01); *F01L 2001/054* (2013.01); *F01L 2103/00* (2013.01)

(58) Field of Classification Search

CPC ... F01L 1/18; F01L 1/267; F01L 1/185; F01L 1/2422; F01L 2103/00

USPC ..... 123/90.12, 90.38, 90.39, 90.36

See application file for complete search history.

(56) References Cited

U.S. PATENT DOCUMENTS 2,793,078 A * 5/1957 W. E. Brill ..... F02M 57/02 239/88

* cited by examiner

*Primary Examiner* — Ching Chang

(74) *Attorney, Agent, or Firm* — Volpe and Koenig, P.C.

(57) ABSTRACT

A variable valve train module has a valve control block positioned on a cylinder head of the engine. The valve control block has a first block and a second block and variable valve train components. These components include at least one valve, a rocker arm, a brake, and a pump configured to receive input from a camshaft. The components are positioned with respect to the blocks such that the first block receives a first portion of the pump and the second block receives a second portion of the pump.

21 Claims, 2 Drawing Sheets

TWO-PIECE BLOCK FOR VARIABLE VALVE TRAIN SYSTEM

FIELD OF INVENTION

Figure 1:
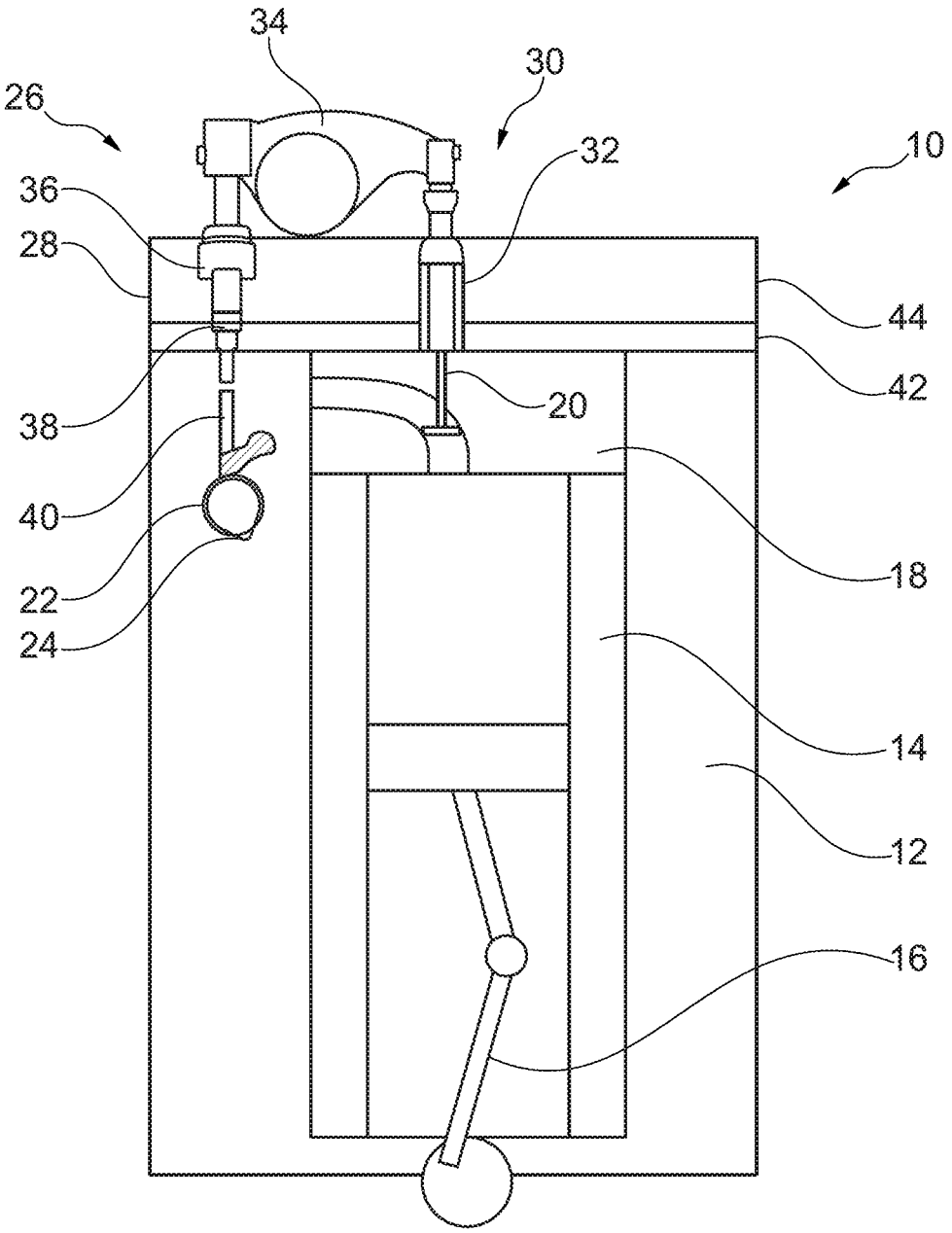

The present invention relates to a variable valve train system for an engine, and, more particularly, to a two-piece block for assisting assembly of a variable valve train system.

BACKGROUND

Some engines include a variable valve train module which controls valve lift through hydraulic operation. This module can include a block positioned on one or more cylinder heads of an engine. The block can include various spaces for components and cavities for hydraulic fluid which together control valve timing and lift. For example, the block may include a pump which pressurizes a cavity connected to a valve actuator, providing valve lift event control in a manner which benefits engine efficiency (e.g., through variable valve actuation depending on the situation).

The components of the variable valve train module, such as the pump and a brake, are positioned in the block and on the engine. There is often very little space in the block to accommodate the various components and any positioning tools that may be needed. Some components, such as the pump, may have sub-components which currently must be assembled on the block, because a pre-assembled version may be too large to fit into the limited space. This complicates and slows the assembly process or requires a more complicated block design.

The present disclosure is directed to improving the assembly of a variable valve train system by providing a two-piece block design which more conveniently accommodates the components of the system.

SUMMARY

In one aspect, the present disclosure is directed to a variable valve train module. The module includes a valve control block positioned on a cylinder head of the engine. The valve control block includes a first block and a second block and variable valve train components. These components include at least one valve, a rocker arm, a brake, and a pump configured to receive input from a camshaft. The components are positioned with respect to the blocks such that the first block receives a first portion of the pump and the second block receives a second portion of the pump.

In another aspect, the present disclosure is directed to a sub-assembled valve control block. The block includes a first block including a through hole, and a second block including a recess in a bottom surface thereof. The second block is stacked on the first block with the through hole is aligned with the recess. The sub-assembled block also includes a pump including a first portion in the through hole and a second portion in the recess.

In yet another aspect, the present disclosure is directed to a method of assembling a variable valve train module. The method includes providing a first block and a second block. The method also includes positioning a bushing of a pump in a recess in a bottom surface of the second block and stacking the second block on the first block such that a piston of the pump extends through a through hole in the first block and outwardly from a bottom of the first block.

BRIEF DESCRIPTION OF THE DRAWING(S)

Figure 2:
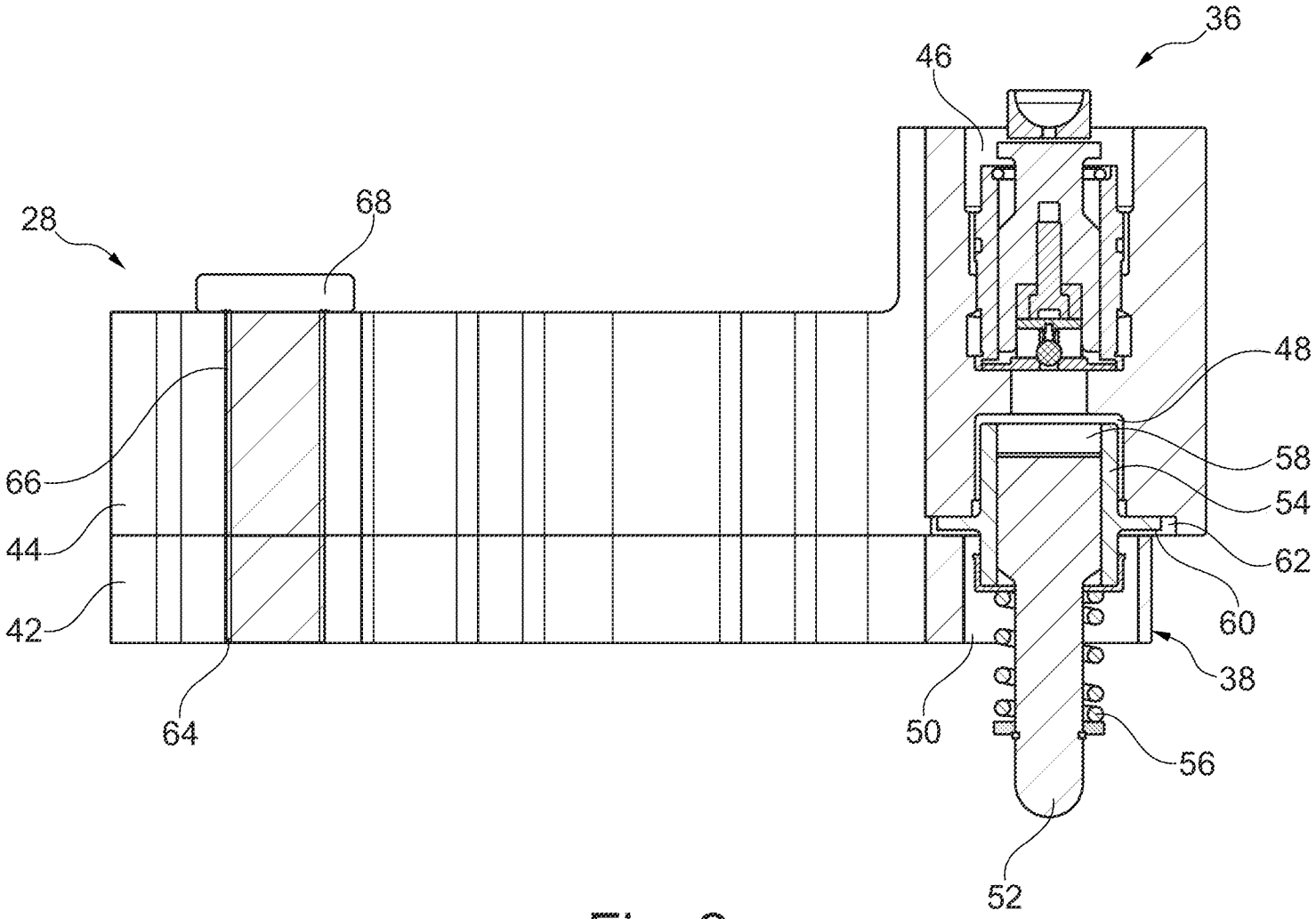

The foregoing Summary and the following detailed description will be better understood when read in conjunction with the appended drawings, which illustrate a preferred embodiment of the invention. In the drawings:

FIG. 1 is a schematic illustration of an engine, including a variable valve train module; and FIG. 2 is a cross-sectional view of a portion of the variable valve train module of FIG. 1.

DETAILED DESCRIPTION OF THE PREFERRED EMBODIMENT(S)

The present disclosure relates to a two-piece block for a variable valve train module. The two-piece block introduces additional surfaces and piloting areas (in comparison to a one-piece block) which accommodate components of the variable valve train system and allow them to be more efficiently and conveniently arranged for assembly.

FIG. 1 schematically illustrates an exemplary embodiment of an engine 10. The engine 10 is preferably an internal combustion engine, but other types of engines are possible. In one embodiment, the engine 10 includes an engine block 12 defining a plurality of cylinders 14. The cylinders 14 receive corresponding reciprocating pistons 16. The pistons 16 move within the cylinders 14 as the engine 10 cycles through various intake, power, compression, and exhaust stages.

The engine 10 further includes one or more cylinder heads 18 which are positioned on top of the engine block 12. The cylinder heads 18 include cavities for receiving at least a portion of a valve 20. The valves 20 include intake and exhaust valves which are selectively opened and closed to facilitate the various combustion stages of the engine 10. The valves 20 may be operated at least in part due to a camshaft 22. The camshaft 22 rotates to provide a cyclical input to the valves 20 through one or more cams 24.

The engine 10 also includes a variable valve train module 26. The variable valve train module 26 is positioned on the cylinder head 18 and includes components which control the valves 20. The variable valve train module 26 includes features which allow for the cyclical input of the cams 24 of the camshaft 22 to be converted into a variably-controllable input to the valves 20. In this way, a lift profile of the valves 20 may be adjusted and controlled through the variable valve train module 26 to promote efficient operation of the engine 10.

The variable valve train module 26 includes a valve control block 28 which supports at least some components 30 of the variable valve train module 26. These components may include, for example, a valve actuator 32, a rocker arm 34, a brake 36, a pump 38, and a pushrod 40. In operation, motion of the cam 24 is translated into motion of the valve 20 through the pushrod 40, rocker arm 34, and valve actuator 32. The camshaft 22 may, in some applications, also act directly onto the pump 38, without the pushrod 40. The brake 36 and pump 38 are situated along this path and operate through pressurization. For example, the pushrod 40 may move the pump 38 to pressurize a cavity. This pressurization is varied and controlled through a solenoid valve in order to vary the lift profile of the valve 20.

FIG. 2 is a cross sectional view of a portion of the variable valve train module 26, including the valve control block 28, the brake 36 and the pump 38. As shown, the valve control block 28 is divided into two separate pieces, including a first block 42 and a second block 44. The first block 42 and the second block 44 may be stacked on each other. The first block 42 is preferably a lower block component which sits on the cylinder heads 18 and the second block 44 is preferably an upper block component which sits on the first block 42.

In a preferred embodiment, the brake 36 fits in an upper recess 46 of the second block 44. The first block 42 receives a first portion of the pump 38 and the second block 44 receives a second portion of the pump 38. For example, the pump 38 may fit in a lower recess 48 of the second block 44 and a through-hole 50 of the first block 42. While not shown, it should be understood that the upper recess 46 and lower recess 48 may be interconnected and configured to in a manner known in the art to allow the brake 36 and pump 38 to operate to vary valve lift. For example, one or more pressurization cavities may be connected with the upper recess 46 and/or lower recess 48.

The pump 38 preferably includes at least a piston 52, a bushing 54, and a spring 56. The first portion of the pump 38 which is in the first block 42 may include a portion of the piston 52, while the second portion of the pump 38 which is in the second block 44 may include at least a portion of the bushing 54. The bushing 54 includes a receiving portion 58 which receives a portion of the piston 52 and the bushing 54 also includes a flange 60 which extends radially outwardly from the receiving portion 58. The piston 52 is configured to reciprocate within the receiving portion 58, such as to pressurize a cavity in the second block 44. In an exemplary embodiment, the pushrod 40 causes movement of the piston 52.

As shown in FIG. 2, the bushing 54 is positioned at the interface between the first block 42 and the second block 44. In an exemplary embodiment, one of the first block 42 and the second block 44 include a groove 62 for receiving the flange 60. For example, the second block 44 may include a cylindrical groove 62 which receives the flange 60. In this way, the second block 44 sits on the first block 42 and the flange 60 is sandwiched therebetween the blocks in the groove 62. This positions the bushing 45 in the overall valve control block 28. The piston 52 extends from the bushing 54 downwardly through the through hole 50 of the first block 42 such that it may interface with the pushrod 40.

In use, the first block 42 and second block 44 are positioned on the cylinder heads 18 of the engine 10, forming the valve control block 28. The first block 42 and second block 44 preferably include aligned apertures 64, 66 for receiving a fastener 68 therethrough to form a connected block 28. The valve control block 28 is configured to be pre-assembled as a single component which includes at least the first block 42, the second block 44, and the pump 38.

If the block 28 is formed as a single piece, it is difficult to properly install the pump 38 because of the lack of space for the components themselves or any positioning tools. For example, the pump 38 would likely need to be installed from the top of the single-piece block with the block already positioned on the engine. This is an extra assembly step and requires precise positioning of the block as well the need for specialized tools or training to properly install the pump.

The two-piece block 28 of the present disclosure, however, allows the pump 38 to be installed in the block 28 prior to installation on the engine 10. This features enables the pump 38 to be placed through a bottom portion of the block 28 (i.e., into the bottom of the second block 44) and held in place by the sandwiched flange 60. The groove 62 may act as a pilot space for positioning the bushing 54 relative to one of the blocks 42, 44 and the bushing 54 is locked in place when the other of the blocks 42, 44 is moved into position. The fastener 68 connects the sub-assembled block into a unitary piece which can be moved into place on the engine 10.

The piston 52 preferably extends outwardly from the bottom of the first block 44, acting as a pilot member to help align the sub-assembled block. For example, the portion of the piston 52 which extends outwardly from the first block 44 can be inserted into an aperture in the cylinder heads 18 to align the valve control block 28. The brake 36 may be assembled as part of the sub-assembled block (e.g., prior to the block 28 being installed on the engine 10) or may be added after the block 28 is in position on the cylinder heads 18.

The blocks 42, 44 are generally rectilinear such that opposing flat surfaces are formed at the top and bottom portions of the blocks 42, 44. In some embodiments, however, the contacting surfaces of the blocks 42, 44 may include interlocking features to insure that they are positioned correctly with respect to each other or may include some configuration other than flat surfaces.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

COMPONENT LIST

10. Engine
12. Engine Block
14. Cylinder
16. Piston
18. Cylinder Heads
20. Valve
22. Camshaft
24. Cam
26. Variable Valve Train Module
28. Valve Control Block
30. Components
32. Valve Actuator
34. Rocker Arm
36. Brake
38. Pump
40. Pushrod
42. First Block
44. Second Block
46. Upper Recess
48. Lower Recess
50. Through-hole
52. Piston
54. Bushing
56. Spring
58. Receiving Portion
60. Flange
62. Groove

64. Aperture
66. Aperture
68. Fastener

What is claimed is:

1. A variable valve train module for an engine, comprising:

a valve control block positioned on a cylinder head of the engine, the valve control block including a first block and a second block; and variable valve train components including at least one valve, a rocker arm, and a pump configured to receive input from a camshaft, wherein the first block receives a first portion of the pump and the second block receives a second portion of the pump.

2. The variable valve train module of claim 1, wherein the pump includes a piston, a bushing, and a spring.

3. The variable valve train module of claim 2, wherein the first portion of the pump includes a portion of the piston and the second portion of the pump includes the bushing.

4. The variable valve train module of claim 3, wherein the first block is positioned on the cylinder head of the engine and the second block is positioned on the first block.

5. The variable valve train module of claim 2, wherein the bushing includes a flange sandwiched between the first block and the second block.

6. The variable valve train module of claim 5, wherein at least one of the first or second block includes a groove which receives the flange.

7. The variable valve train module of claim 5, wherein the bushing includes a receiving portion which receives a portion of the piston and the flange extends outwardly from the receiving portion.

8. The variable valve train module of claim 2, wherein the piston extends outwardly from a bottom of the first block and into the cylinder head.

9. A sub-assembled valve control block, comprising:

a first block including a through hole;

a second block including a recess in a bottom surface thereof, the second block being stacked on the first block with the through hole aligned with the recess; and a pump configured to receive mechanical input from a camshaft, the pump including a first portion in the through hole and a second portion in the recess.

10. The block of claim 9, wherein the pump includes a piston, a bushing, and a spring.

11. The block of claim 10, wherein the first portion of the pump includes a portion of the piston and the second portion of the pump includes the bushing.

12. The block of claim 11, wherein the bushing includes a receiving space which receives a portion of the piston and the piston extends from the receiving space into the through hole.

13. The block of claim 12, wherein the piston extends outwardly from a bottom of the first block.

14. The block of claim 10, wherein the bushing includes a flange sandwiched between the first block and the second block.

15. The block of claim 9, wherein at least one of the first or second block includes a groove which receives the flange.

16. The block of claim 9, wherein the first block and the second block include aligned apertures which receive a fastener.

17. The block of claim 9, wherein the mechanical input is either from a pushrod translating motion of the camshaft or from the camshaft acting directly on the pump.

18. A method of assembling a variable valve train module, comprising:

providing a first block and a second block;

positioning a bushing of a pump in a recess in a bottom surface of the second block, wherein the pump is configured to receive mechanical input from a camshaft; and stacking the second block on the first block such that a piston of the pump extends through a through hole in the first block and outwardly from a bottom of the first block.

19. The method of claim 18, wherein positioning the bushing of the pump includes positioning a flange of the bushing in a groove in the second block.

20. The method of claim 18, further including attaching the first block to the second block with a fastener extending through aligned apertures in the first and second blocks.

21. The method of claim 18, further comprising positioning the stacked first and second blocks on a cylinder head of an engine, including aligning a portion of the piston that extends outwardly from the bottom of the block with an opening in the cylinder head.

* * * * *